US008096510B2

(12) United States Patent
Shogren et al.

(10) Patent No.: US 8,096,510 B2
(45) Date of Patent: Jan. 17, 2012

(54) TRACTION KITE WITH DEFORMABLE LEADING EDGE

(75) Inventors: Alexander Shogren, Delray Beach, FL (US); Peter Stiewe, Delray Beach, FL (US)

(73) Assignee: Ride Best, LLC, Rodanthe, NC (US)

( * ) Notice: Subject to any disclaimer, the term of this patent is extended or adjusted under 35 U.S.C. 154(b) by 351 days.

(21) Appl. No.: 12/437,112

(22) Filed: May 7, 2009

(65) Prior Publication Data

US 2009/0277997 A1 Nov. 12, 2009

Related U.S. Application Data

(60) Provisional application No. 61/051,033, filed on May 7, 2008.

(51) Int. Cl.
*A63H 27/08* (2006.01)

(52) U.S. Cl. ..... 244/153 R

(58) Field of Classification Search ..... 244/153 R, 244/154, 155 R, 155 A, 153 A
See application file for complete search history.

(56) References Cited

U.S. PATENT DOCUMENTS 4,363,458 A * 12/1982 Jones et al. ..... 244/153 R
4,708,078 A 11/1987 Legaignoux et al.
4,846,424 A * 7/1989 Prouty ..... 244/153 R
4,892,272 A * 1/1990 Hadzicki ..... 244/153 R
5,033,698 A * 7/1991 Schimmelpfennig ..... 244/153 R
5,433,401 A 7/1995 Ricketts
5,556,057 A 9/1996 Davies
7,017,860 B2 * 3/2006 Royannais et al. ..... 244/155 A
7,032,864 B2 * 4/2006 Logosz ..... 244/153 R
7,374,133 B2 5/2008 Legaignoux et al.
7,494,093 B2 * 2/2009 Legaignoux et al. ..... 244/145
7,810,759 B2 * 10/2010 Eberle et al. ..... 244/155 A

* cited by examiner

*Primary Examiner* — Richard Price, Jr.
(74) *Attorney, Agent, or Firm* — Mark D. Bowen, Esq.; Malin Haley DiMaggio Bowen & Lhota, P.A.

(57) ABSTRACT

A leading edge inflatable traction kite wherein the leading edge structure includes a plurality of spaced segments that are fabricated from a material with a higher elasticity, thus allowing for a greater amount of twisting and bending. The inflatable leading edge includes a series of elastically deformable segments disposed throughout the length thereof to facilitate selective torsional deformation of the leading edge and resulting overall angle of attack of the kite. These elastically deformable segments are preferably integrally formed as part of the leading edge support and are comprised of a material with a high elasticity, namely a higher elasticity than the remaining leading edge segments. Providing elastically deformable segments of high elasticity dispersed along the leading edge combined with regions of lower elasticity maximizes responsiveness and control by allowing leading edge deformation in response to user applied force, while the providing sufficient support to maintain kite stability.

7 Claims, 5 Drawing Sheets

TRACTION KITE WITH DEFORMABLE LEADING EDGE

CROSS REFERENCE TO RELATED APPLICATIONS

This application claims the benefit of provisional U.S. Patent Application Ser. No. 61/051,033, filed on May 7, 2008.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to propulsive wings and traction kites, used for applying a traction force and/or pulling a load. More particularly the present invention relates to traction kite having a generally tubular inflatable leading edge comprised of multiple segments, with certain segments comprised of deformable material such that the leading edge is easily deformed to improve the overall turning performance and handling of the kite, while still providing sufficient leading edge structural stability.

2. Description of Related Art

The use of kites as a means of propulsion has existed for over a century. Kites were first used as a means of propulsion in pulling boats. Through already popular water and land based board sports such as surfing and snowboarding, the sports of kiteboarding and snow kiting have grown. These sports adapt the principals of surfing and snowboarding to include kites as a method for generating speed. A number of advances, particularly to the design of the kite propulsion system, have led to improvements in safety, increases in top attainable speeds, and improvements in overall performance.

Most traction kites currently used in board sports are constructed with flexible canopy having an inflatable leading edge armature which distributes the load via ropes at the lateral ends and/or are fixed to the leading edge. As used therein the terms "traction kite" or "kite" shall mean a propulsive wing that harnesses wind power to pull a rider through the water or snow on a riding platform (e.g. a board). A traction kite of this type is described in U.S. Pat. No. 4,708,078 to Legaignoux et al., wherein a basic design for a leading edge inflatable ("LEI") kite is disclosed. Legaignoux discloses an inflatable leading edge having an inflatable armature covered by a flexible envelope. The Legaignoux leading edge is generally formed of material having monolithic deformation characteristics.

As kite sports have evolved, demand for kites with improved performance characteristics has grown. Specifically, kite users desire kites with improved handling and control, faster turning speeds, and more responsive control achieved with minimal user input force. A traction kite is conventionally controlled by a series of control lines, commonly referred to as a bridle. Turning speed and force needed to initiate turning has been found to be an important performance character in tube kites, particularly kites bigger than 9.0 square meters in size. Turning a propulsive kite is typically achieved by deforming one side of the kite with respect to the other side. By elastically deforming one side of the kite, the angle of attack is adjusted, causing the kite to change direction and/or to add power or decrease power (i.e. depower). The ability to twist and deform the kite depends on the elastic (e.g. stretch) characteristics of the material forming the leading edge, the diameter of the leading edge, and inflation pressure. At the same time the leading edge needs to provide structural stability to prevent the tube kite from deformation caused by appearing loads.

In general there has been an increased demand for traction kites having improved performance characteristics for use in kite sports, such as kiteboarding and snowkiting (i.e. snow kiteboarding). The amount that a kite elastically deforms based on a given applied force, which force is created by the user and transmitted through the lines and subsequent bridle structure, is dependent on the ease by which the leading edge of the kite bends and twists. Bending and twisting of the leading edge is directly related to both the design parameters and the characteristics of the materials used in creating the leading edge support structure. Specifically, leading edges with low air inflation pressures that are made from a material with a high elasticity provide the maximum amount of bending, whereas leading edges with high air inflation pressures that are made of material with a low elasticity minimize bending. In any event, however, the leading edge must be rigid enough to provide sufficient support to maintain the stability of the kite when in use.

The prior art, however, fails to disclose or suggest a propulsive wing that maximizes control responsiveness by providing an inflatable leading edge that is capable increased elastic deformation while maintaining sufficient structural rigidity to maintain stability in flight. There is therefore a need for a propulsive wing with an inflatable support structure that is designed to maximize the ease by which the support structure can be elastically deformed, while providing a support structure that is sufficiently rigid to maintain stability during flight.

BRIEF SUMMARY OF THE INVENTION

The present invention overcomes the disadvantages and limitation of the prior art by providing a leading edge inflatable traction kite having a compound leading edge structure that includes a plurality of spaced segments that are fabricated from a material having elastic deformation characteristics that allow for a greater amount of twisting and bending as compared with prior art designs. In a preferred embodiment, the inflatable leading edge includes a series of elastically deformable segments that are inter-disposed at locations throughout the length of the leading edge to facilitate selective deformation of the leading edge and overall angle of attack. The elastically deformable segments are preferably integrally formed as part of the leading edge support and are comprised of a material with a high elasticity, namely a higher elasticity or stretch factor than the remaining leading edge segments or remainder of the leading edge depending on the number of elastically deformable segments included in the overall leading edge. Providing elastically deformable segments, e.g. segments of high elasticity, dispersed along the leading edge combined with segments of lower elasticity maximizes responsiveness and control by allowing leading edge deformation in response to user applied force, while the providing sufficient support to maintain kite stability.

Accordingly, it is an object of the present invention to provide a leading edge inflatable traction kite having improved performance characteristics.

Another object of the present invention is to provide a leading edge inflatable traction kite that provides sufficient support to maintain stability while maximizing the amount of deformation for a given applied force.

Still another object of the present invention is to provide a leading edge traction kite, wherein the leading edge is comprised of a series of deformable and twistable segments inter disposed within more rigid support segments to increase kite deformation and wing warping.

It is yet another object of the present invention to provide a leading edge traction kite that provides optimum performance characteristics, in particular the ability to perform quick turns and maneuvers.

It is furthermore another object of the present invention to provide a leading edge inflatable traction kite that is inexpensive to manufacture, therefore allowing for widespread distribution.

These and other objects are met by the present invention which will become more apparent from the accompanying drawing and the following detailed description of the drawings and preferred embodiments.

DETAILED DESCRIPTION OF THE INVENTION

Figure 1:
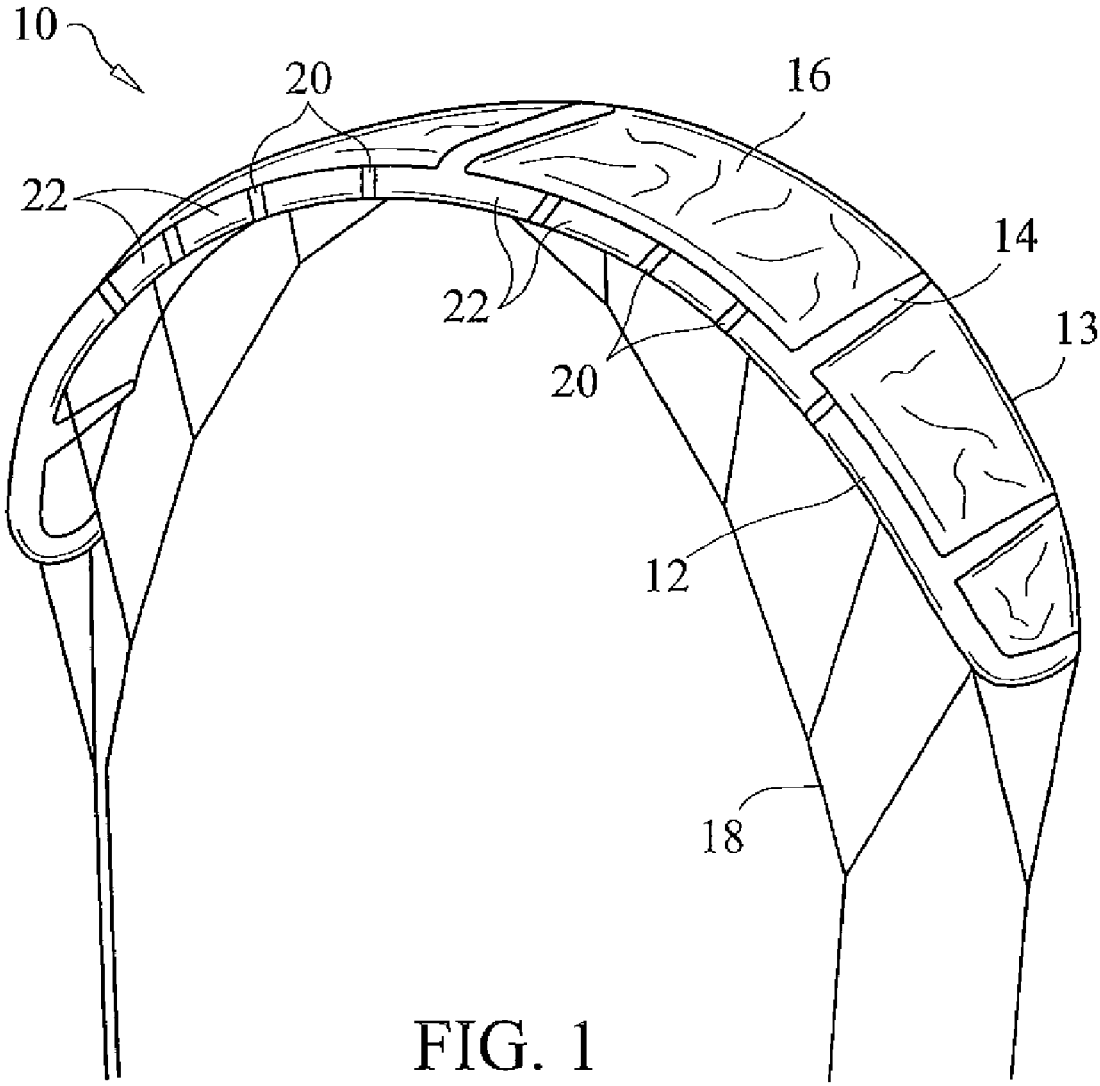
FIG. 1 is a perspective view of the inflated leading edge traction kite fitted with control lines in accordance with the present invention.

With reference now to the drawings, FIG. 1 shows a perspective view of a traction kite having an inflatable leading edge in accordance with the present invention. Kite 10 includes an inflatable, elastically deformable leading edge spar 12 extending across the entire longitudinal front side of kite 10. Leading edge spar 12 comprises an inflatable tubular structure as more fully detailed herein. A series of inflatable struts or ribs 14 extend generally perpendicularly out from the inflatable leading edge 12 towards the trailing edge 13 of the kite 10. Inflatable ribs 14 are preferably in fluid communication with leading edge 12 such that inflation of leading edge 12 causes inflation of ribs 14. Leading edge 12 and ribs 14 form the support structure for the canopy 16 of kite 10. Canopy 16 is connected to and extends between parallel ribs 14 and the leading edge strut 12 as is generally known in the art. Leading edge 12 and canopy 16 serve as the main surfaces over which air flows, leading to the creation of an area of low pressure over the top of the canopy 16 and an area of high pressure beneath the canopy 16 such that kite 10 aerodynamically functions as a wing.

As best illustrated in FIG. 1, kite 10 is preferably fitted with a conventional bridle system 18 that includes a plurality of control lines, which are connected at various points along leading edge 12 and opposing side ends of the kite 10. Bridle system 18 is controlled by the user and functions to allow the rider to selectively apply control forces to portions of kite 10. These applied control forces, cause kite 10 to deform thus changing the angle of attack. Changing the angle of attack changes the aerodynamic characteristics of kite 10 thereby causing it to turn, or depower, or increase power, depending on the resulting angle of attack. For example, lowering the angle attack on one side of the kite 10 lowers the pressure difference on that side of the kite 10 thereby reducing the propulsive force generated and causing the kite 10 to turn in a direction towards the side with the higher angle of attack. Through this mechanism, the direction in which the kite 10 is flying is controlled thereby allowing the kite to be maneuvered in kite propulsion based sports.

A significant aspect of the present invention involves providing a traction kite having improved performance and control characteristics, namely, the ability to quickly turn and change direction in response to the rider's control motions and selective application or reduction of force. This characteristic is directly related to how quickly and easily the angle of attack of the kite is changed. The degree and speed by which the angle of attack is changed largely depends on the flexibility and deformability of the kite 10 support structure, and in particular leading edge 12. While it is desirable to provide a deformable leading edge structure in order to provide an improved turning performance, the leading edge 12 must remain rigid enough to provide stability for the kite 10 during flight.

Accordingly, a significant aspect of the present invention involves providing the leading edge that is elastically deformable. More particularly, leading edge 12 includes resilient sections formed by elastically deformable (e.g. flexible) segments, referenced as 20, comprised of material having a relatively high level of elasticity disposed between less deformable segments, referenced as 22, comprised of material having a relatively lower level of elasticity. Elastically deformable segments 20 are more readily deformable, both torsionally and angularly. In order to maximize control and turning performance while providing a sufficiently rigid support structure, a kite in accordance with the present invention includes a leading edge 12 preferably including with a plurality of elastically deformable/resilient segments 20 disposed between conventional (less resilient) segments 22 in spaced relation along the length of leading edge 12 so as to form a composite segmented leading edge that is more responsive to control input from the rider while maintaining sufficient structural stability and leading edge support. In a preferred embodiment, resilient segments 20 are formed of a KEVLAR® reinforced fabric. KEVLAR® is a registered trademark of E.I. DuPont De Nemours and Company.

Figure 2:
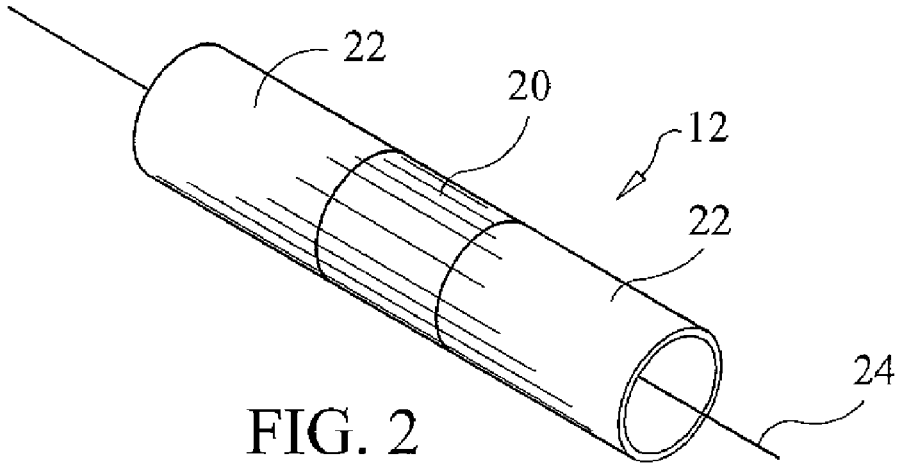
FIG. 2 is a partial perspective view of a leading edge adapted with a deformable segment in accordance with the present invention.

FIG. 2 is a partial detailed perspective view depicting a portion of inflatable leading edge 12 adapted in accordance with the present invention. Leading edge 12 includes a deformable segment 20 disposed between two support segments 22. In a preferred embodiment, deformable segment 20 is integrally formed with adjacent leading edge segments 22 to form a generally monolithic tubular-shaped inflatable leading edge structure suitable for inflation. Deformable segment 20 is preferably fabricated from a material with a high elasticity or stretch characteristics as compared with segments 22. By using a material with a high elasticity, deformable segment 20 is easily deformed and contorted elastically (i.e. torsionally deformed and angularly deformed) in response to a small applied force. The term "elasticity" refers to the property of a material or a structure formed from a configuration of one or more materials that enables it to change shape in direct response to a force effecting such as change and to recover its original from upon removal of the force. Through this elastic deformation of the leading edge, the angle of attack of the kite is rapidly changed. Support segments 22 are made from a material with a relatively low elasticity (as compared with elastically deformable segments 20), and thus function to maintain overall structural rigidity to allow the kite to maintain stability during flight. Accordingly, support segments 22 twist or bend very little (or not at all) as compared with elastically deformable segments 20. By combining a plurality of support segments 22 with a plurality of spaced elastically deformable segments 20, a composite segmented inflatable leading edge 12 is formed and optimized to deform under a minimal applied user force while still remaining rigid enough to stabilize the kite during flight. Through this design of the inflatable leading edge strut 12, a traction kite with maximized performance characteristics, and in particular turning ability, is achieved. In accordance with a preferred embodiment of the present invention leading edge 12 is adapted to include a plurality of elastically deformable segments or sections 20 disposed between conventional segments or segments 22 in spaced relation along the leading edge, however, any suitable number of elastically deformable segments including just one may be used. In a preferred embodiment, the conventional segments account for most of the length of the leading edge, with the elastically deformable segments being relatively thin (as measured along the leading edge) so as to account for a combined relatively small amount of the leading edge total length. A single deformable segment 20 may be disposed generally along the center of the leading edge and between tow conventional segments 22, the use of multiple segments, however, has been found to provide significantly improved performance.

Figure 3:
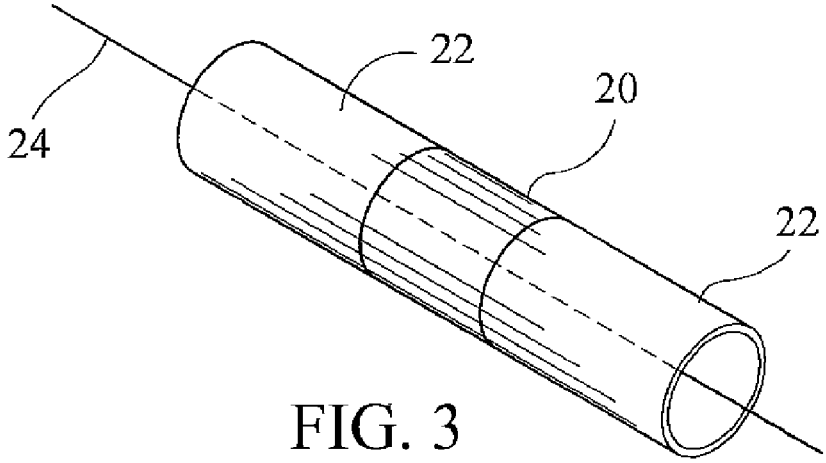
FIG. 3 shows the leading edge of FIG. 2 with a circumferential reference line in a non-torsionally deformed configuration.
Figure 4:
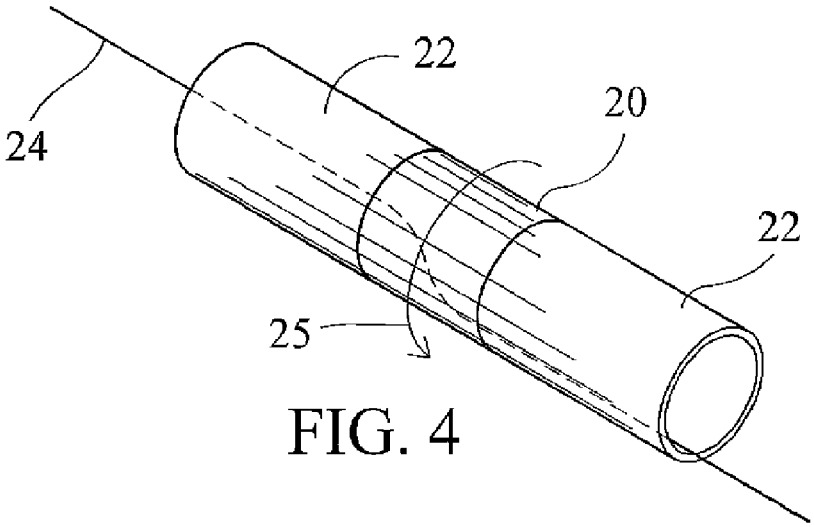
FIG. 4 shows the leading edge of FIG. 3 with a circumferential reference line in a torsionally deformed configuration.

FIGS. 2-4 illustrate torsional deformation of a leading edge 12 adapted in accordance with the present invention. More particularly, FIGS. 2-4 are partial views of a portion of an inflated tubular leading edge 12 showing a deformable segment 20 disposed between conventional (e.g. less elastic) segments 22. FIG. 3 includes a circumferentially disposed dashed reference line 24, running along the circumferential outer surface of segments 20 and 22, to show the relative relation of each segment for purpose of illustrating torsional deformation (e.g. twisting of leading edge segments). For illustration purposes segments 20 and 22 are depicted in FIG. 3 in a non-deformed configuration. Once a force is applied to the leading edge by the user via bridle lines 18 the leading edge may be placed in a torsionally deformed configuration as best illustrated in FIG. 4. The twisting of segment 20 occurs causes the leading edge to deform thereby changing the angle of attack so as to cause the kite to turn, increase power, or depower, in a more responsive manner depending on user control input.

Figure 5:
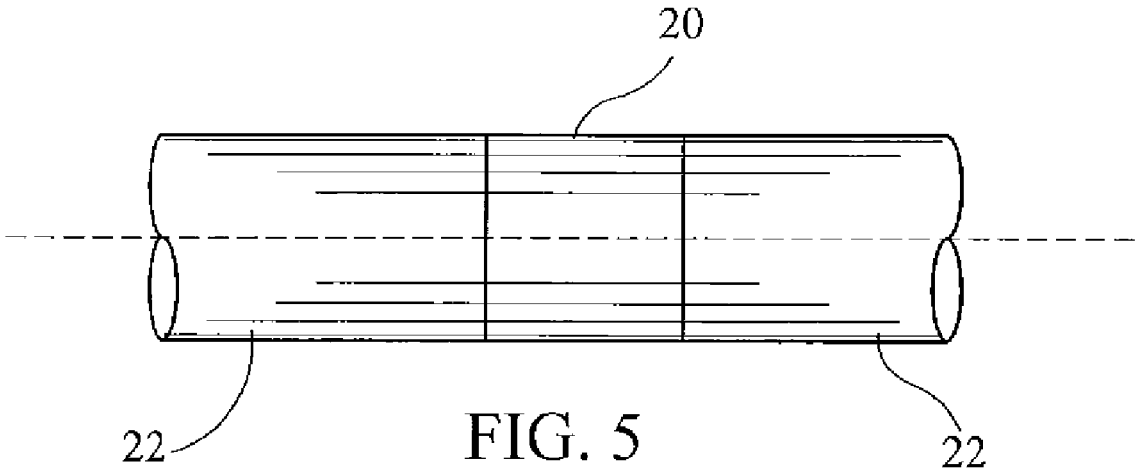
FIG. 5 is a partial perspective view of a leading edge adapted with a deformable segment in accordance with the present invention with an axial reference line in a non-axially deformed configuration.
Figure 6:
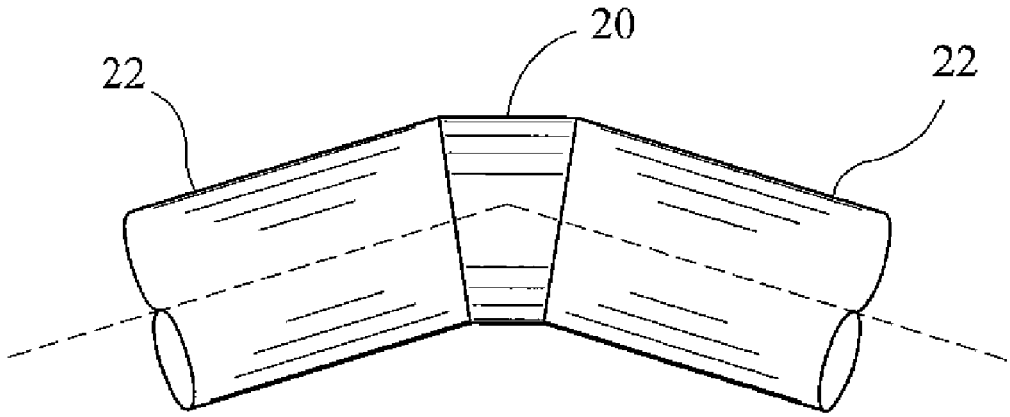
FIG. 6 shows the partial leading edge in an axially deformed configuration.

A further performance advantage with the present invention, is illustrated in FIGS. 5 and 6. More particularly, FIGS. 5 and 6 illustrate axial bending and/or angular deformation of a leading edge 12 adapted in accordance with the present invention. More particularly, FIGS. 5 and 6 are partial front views of a portion of an inflated tubular leading edge 12 showing a deformable segment 20 disposed between conventional (e.g. less-elastic) segments 22. FIG. 5 shows the leading edge illustrated with an axially disposed dashed reference line 24, running along longitudinal axis thereof. FIG. 6 shows the leading edge deformed along it longitudinal axis. More particularly, opposing segments 22 are illustrated as being disposed in angular relation (i.e. bent). The angular deformation is facilitated by deformable segment 22 whereby the top portion of segment 22 longitudinally expands under stress, while the bottom portion thereof contracts in compression. Once a force is applied to the leading edge by the user via bridle lines 18 the leading edge may be placed in a deformed configuration as best illustrated in FIG. 6. The deformed leading edge thereby changes the angle of attack or structure of the wing so as to cause the kite to turn, increase power, or depower, in a more responsive manner depending on user control input. While deformation along the longitudinal axis may contribute to the increased performance discussed herein, it is believed that torsional deformation is most responsible for the performance benefits associated with a deformable segmented leading edge as disclosed herein.

Figure 7:
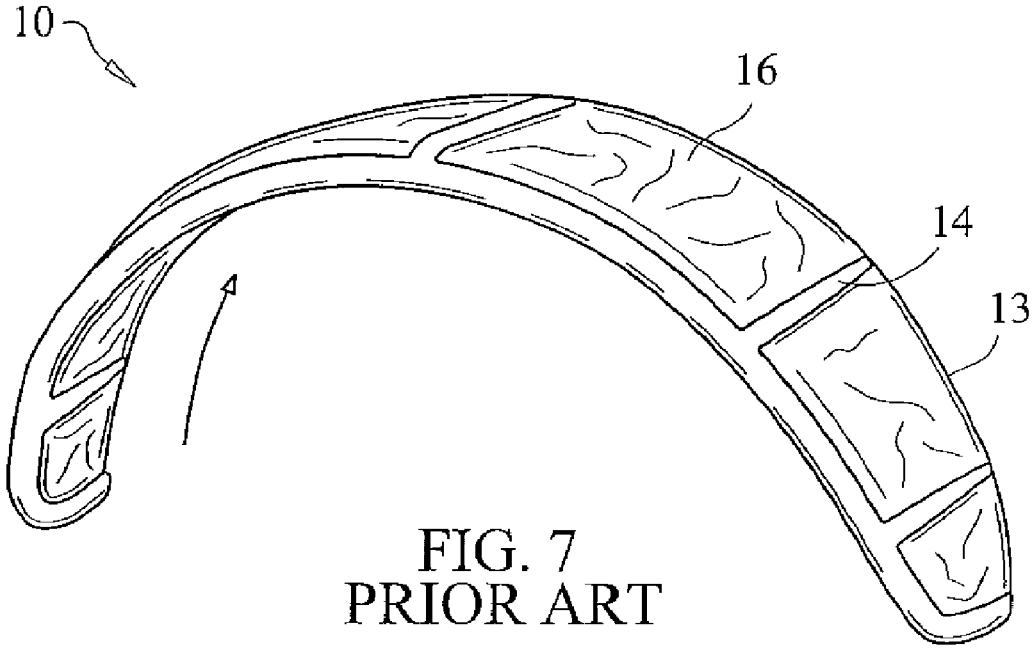
FIG. 7 PRIOR ART
FIG. 7 depicts a prior art kite having a conventional inflatable leading edge with an arrow illustrating a limited portion of the canopy that provides turning force.
Figure 8:
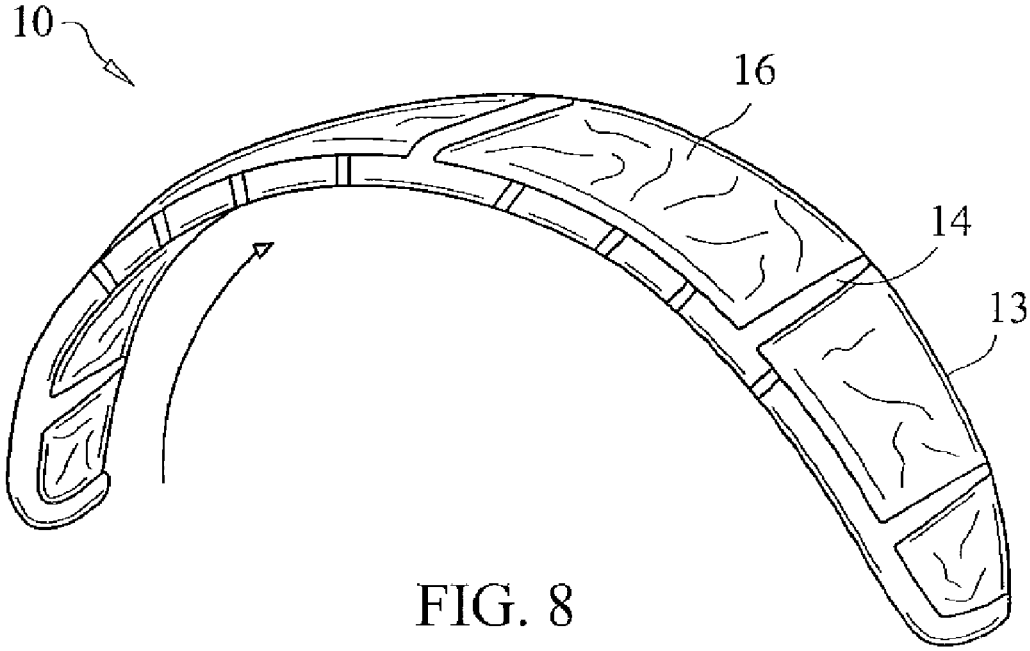
FIG. 8 depicts a kite having a deformable leading edge in accordance with the present invention with an arrow illustrating an increased portion of the canopy that provides turning force as a result of leading edge deformation.

FIG. 7 depicts a prior art kite having a conventional inflatable leading edge with an arrow illustrating a limited portion of the canopy that provides turning force and FIG. 8 depicts a kite having a deformable leading edge in accordance with the present invention with an arrow illustrating an increased portion of the canopy that provides turning force as a result of leading edge deformation. A deformable leading edge in accordance with the present invention thus improves performance by allowing the leading edge sections twist independently thereby resulting in significantly increased deformation so as to expose a larger portion of canopy surface area to the wind.

Figure 9:
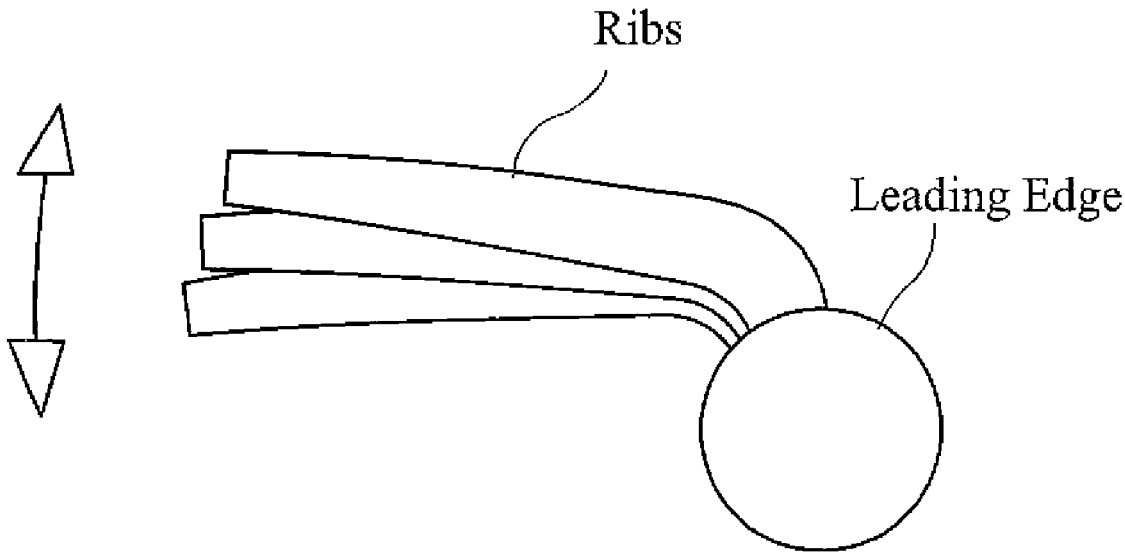
FIG. 9 PRIOR ART
FIG. 9 is a schematic side view of a leading edge and ribs of a prior art kite having a standard leading edge construction in accordance with the prior art that inhibits twisting ability.
Figure 10:
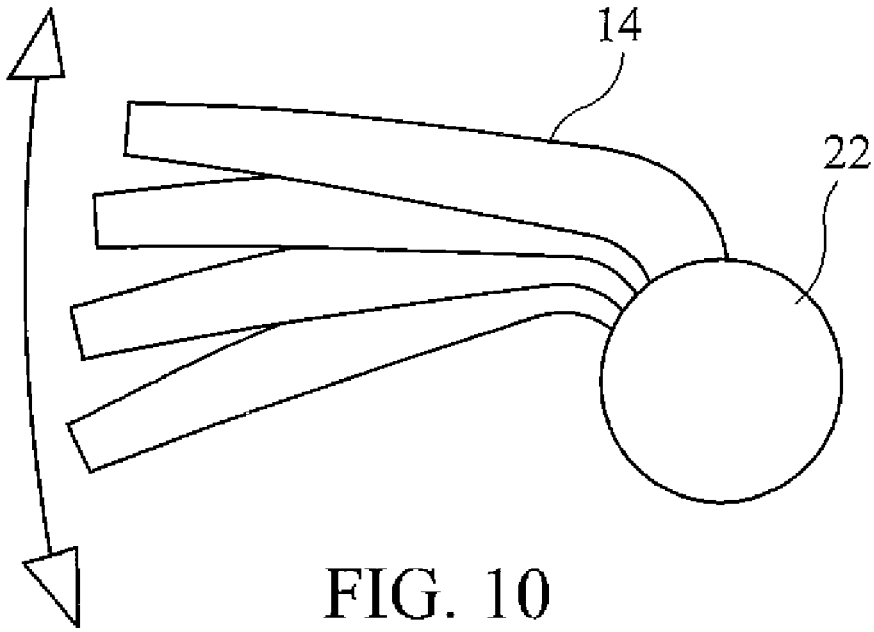
FIG. 10 is a schematic side view of a leading edge and ribs of a kite having a deformable edge in accordance with the present invention.

FIG. 9 is a schematic side view of a leading edge and ribs of a prior art kite having a standard leading edge construction in accordance with the prior art that inhibits twisting ability, and FIG. 10 is a schematic side view of a leading edge and ribs of a kite having a deformable edge in accordance with the present invention. As illustrated in FIG. 10 the providing a leading edge with resilient segments 20 allows the leading edge to twist significantly more resulting in greater canopy geometry change as compared with the prior art kite illustrated in FIG. 9. A kite having a deformable leading edge in accordance with the present invention provides a number of significant advantages, including less control input pressure to initiate a turn, improved handling in gusty winds, and ease The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A traction kite comprising:

an inflatable tubular leading edge, a plurality of inflatable ribs projecting generally rearward from said leading edge, and a canopy attached to said leading edge and said plurality of inflatable ribs;

said tubular leading edge comprising a composite structure having a plurality of torsionally deformable tubular segments disposed in spaced relation along the length of said leading edge;

said torsionally deformable tubular segments enabling deformation of said leading edge in response to control input forces.

2. A traction kite according to claim 1, wherein said elastically deformable tubular segments comprise reinforced fabric.

3. A traction kite according to claim 1, wherein said elastically deformable tubular segments are angularly deformable.

4. A traction kite having a deformable leading edge, said traction kite comprising:

an inflatable tubular leading edge, a plurality of inflatable ribs projecting generally rearward from said leading edge, and a canopy attached to said leading edge and said plurality of inflatable ribs;

said tubular leading edge comprising a composite structure formed by a generally tubular armature having a plurality of main armature segments fabricated with a first material configuration, and a plurality of resilient armature segments fabricated with a second material configuration;

each of said resilient armature segments being disposed between adjacent main armature segments;

said second material configuration having a higher level of elasticity than said first material configuration;

whereby said resilient armature segments function to allow said leading edge to deform in response to control input forces.

5. A traction kite according to claim 4, wherein said second material configuration comprises reinforced fabric.

6. In a traction kite for towing a rider, said traction kite connected to the rider by a bridle system, said traction kite having an inflatable leading edge, a plurality of inflatable ribs projecting generally rearward from said leading edge, and a canopy attached to said leading edge and said plurality of inflatable ribs, wherein the improvement comprises forming the leading edge as a composite structure having a plurality of elastically deformable segments disposed in spaced relation along the length thereof, said elastically deformable segments disposed between generally less elastically deformable segments, with said deformable tubular segments enabling deformation of said leading edge in response to control input forces thereby allowing the rider to selectively vary the geometry of the traction kite.

7. A traction kite for towing a rider according to claim 6, wherein said elastically deformable segments deform torsionally.

* * * * *